US005961313A

United States Patent [19]

Haumann et al.

[11] Patent Number: 5,961,313

[45] Date of Patent: Oct. 5, 1999

[54] METHOD OF OPERATING A SWIRL STABILIZED BURNER AND BURNER FOR CARRYING OUT THE METHOD

[75] Inventors: Jürgen Haumann, Rekingen; Hans Peter Knöpfel, Besenbüren, both of Switzerland; Thomas Sattelmayer, Erding, Germany

[73] Assignee: ABB Research Ltd., Zurich, Switzerland

[21] Appl. No.: 09/032,798

[22] Filed: Mar. 2, 1998

[30] Foreign Application Priority Data

Mar. 18, 1997 [EP] European Pat. Off. ..... 97810162

[51] Int. Cl.[6] ..... F23C 6/04

[52] U.S. Cl. ..... 431/10; 431/8; 431/351; 431/353

[58] Field of Search ..... 431/8–10, 115, 431/350–354, 116

[56] References Cited

U.S. PATENT DOCUMENTS

| | | | |
|---|---|---|---|
| 4,054,028 | 10/1977 | Kawaguchi | 431/353 |
| 5,453,004 | 9/1995 | Hofbauer | 431/9 |
| 5,545,032 | 8/1996 | Jansohn et al. | 431/9 |
| 5,645,410 | 7/1997 | Brostmeyer | 431/8 |

FOREIGN PATENT DOCUMENTS

| | | |
|---|---|---|
| 0321809B1 | 6/1989 | European Pat. Off. . |
| 0436113A1 | 7/1991 | European Pat. Off. . |
| 0436113B1 | 7/1991 | European Pat. Off. . |
| 0617231A1 | 9/1994 | European Pat. Off. . |
| 0629817A2 | 12/1994 | European Pat. Off. . |
| WO90/03538 | 4/1990 | WIPO . |

*Primary Examiner*—James C. Yeung
*Attorney, Agent, or Firm*—Burns, Doane, Swecker & Mathis, L.L.P.

[57] ABSTRACT

In a method of operating a swirl-stabilized burner operated with gaseous and/or liquid fuels (12, 16), in which combustion air (7) or a mixture of recycled flue gas (30) and fresh air (29), which mixture is formed by injector delivery, and fuel (12, 16) are intensively mixed by means of a swirl generator (37) and then burned, in the course of which a backflow zone (24), which stabilizes the flame, is formed, starting air (38), which has at least a radial velocity component, is injected during the starting action at the downstream end of the swirl generator (37) in such a way as to be directed from the margin of the burner into the center. The injection of the starting air (38) is switched off after the end of the starting action, so that the burner works in such a way as to be unaffected in normal operation. The invention improves the ignition conditions, increases the flame stabilization, and reduces the pollutant emissions when the burner is being started.

17 Claims, 6 Drawing Sheets

METHOD OF OPERATING A SWIRL STABILIZED BURNER AND BURNER FOR CARRYING OUT THE METHOD

BACKGROUND OF THE INVENTION

1. Field of the Invention

The invention relates to the field of combustion technology. It relates to a method of operating a swirl-stabilized burner operated with gaseous and/or liquid fuels and to a burner, in particular a premix burner, suitable for this.

2. Discussion of Background

Swirl-stabilized burners are known. In this type of burner, a swirl generator having a supercritical swirl provides for intensive mixing of fuel and combustion air. The flame stabilization is based on the generation of a backflow bubble, also called backflow zone, which results from the breakdown of the vortex. The ignition of the flame is initiated in front of the stagnation point of this backflow zone, and a stable flame front forms.

An example of swirl-stabilized burners of this type is the burner of the double-cone design, the basic construction of which is described in EP 0 321 809 B1. This premix burner essentially comprises at least two hollow conical sectional bodies, which complement one another to form one body and have tangential air-inlet slots and feeds for gaseous and liquid fuels, in which burner the center axes of the hollow conical sectional bodies have a conicity widening in the direction of flow and run offset from one another in the longitudinal direction. A fuel nozzle is placed at the burner head in the conical interior space formed by the conical sectional bodies. Via gas injectors arranged along the inlet slots, the gaseous fuel is fed to the combustion-air flow prior to its inflow into the burner interior space. The fuel/air mixture is therefore formed directly at the end of the tangential air-inlet slots.

The increase in swirl along the cone axis, in combination with the sudden widening in cross section at the burner outlet, leads to the formation of a backflow zone (inner recirculation zone) downstream of the burner outlet on the burner axis, which backflow zone stabilizes the flame. The ignition of the flame is initiated in front of the stagnation point of this inner backflow zone. As short a backflow zone as possible is aimed at.

If these burners are designed in an unfavorable manner, however, the central backflow zone spreads well downstream on the cone axis into the combustion chamber. A long, almost cylindrical, backflow zone results, the heat being extracted from the backflowing flue gases in the core. Consequently, when the burner is being started, only cold medium is transported back at the stagnation point in front of the backflow zone, at which the flame stabilizes. This has the disadvantage that the ignition of the fuel/air mixture is made more difficult or is even prevented. In addition, the flame stabilization is weakened and the pollutant emissions, in particular carbon monoxide and unburnt hydrocarbons, are increased when the burner is being started.

These disadvantages may also occur in burners having passive flue-gas recirculation by injector delivery, which are described, for example, in EP 0 436 113 B1. There, during the starting action, in addition to the injection of normal combustion air into the vicinity of the injectors, air is injected into the burner head. In the applications realized at present, the result of this is that the surrounding area of the burner head is purged with the cold starting air and the recycling of hot flue gases from the combustion space is impaired. The system heats up only very slowly.

Here too, therefore, the ignition of the fuel/air mixture is made more difficult, the flame stabilization is weakened, and the pollutant emissions are increased.

SUMMARY OF THE INVENTION

Accordingly, one object of the invention, in attempting to avoid all these disadvantages, is to develop a method of operating a swirl-stabilized burner, which method permits the ignition without problem during the starting phase of the burner and leads to high flame stabilization and to low pollutant-emission values. Normal operation of the burner is not to be affected. Furthermore, a burner, in particular a premix burner, for carrying out this method is to be provided.

According to the invention, this object is achieved by a method in that starting air, which has at least a radial velocity component, is injected during the starting action at the downstream end of the swirl generator in such a way as to be directed from the margin of the burner into the center, and that the injection of the starting air is switched off after the end of the starting action. According to the invention, this object is achieved in the case of a swirl-stabilized burner in that at least two means for the at least partially radial injection of starting air are arranged at the downstream end of the swirl generator, which means are connected to feed lines, which can be closed as desired.

The advantages of the invention consist, inter alia, in the fact that favorable ignition conditions are created, the flame stabilization is improved, and the pollutant emissions are reduced when the burner is being started. Zones of high shear and turbulence are produced between the injected starting-air jets and the swirled main flow and these zones intensify the transport of substances. The central backflow bubble is cut off and an intensive fireball develops in the immediate vicinity of the burner. Most of the cold starting air passes through the reaction zone into the hot vortex-breakdown zone and at the same time transports fuel into the center and then in the direction of the swirl generator. Consequently, both mass flows participate immediately in the reaction and heat up considerably before the flame-stabilization point is reached. In this way, purging of the surrounding area with cold medium, as described in the prior art, is prevented.

It is especially expedient if the starting air is injected into the main flow purely radially and thus without a swirl.

However, it is also advantageous if the starting air is injected radially/axially or radially/tangentially, so that, in addition to the radial velocity component, it also has an axial and/or tangential velocity component. It is especially important here for the starting air to have a swirl component opposed to the main flow, since the zones of especially high shear and turbulence between starting-air flow and main flow are thereby produced.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
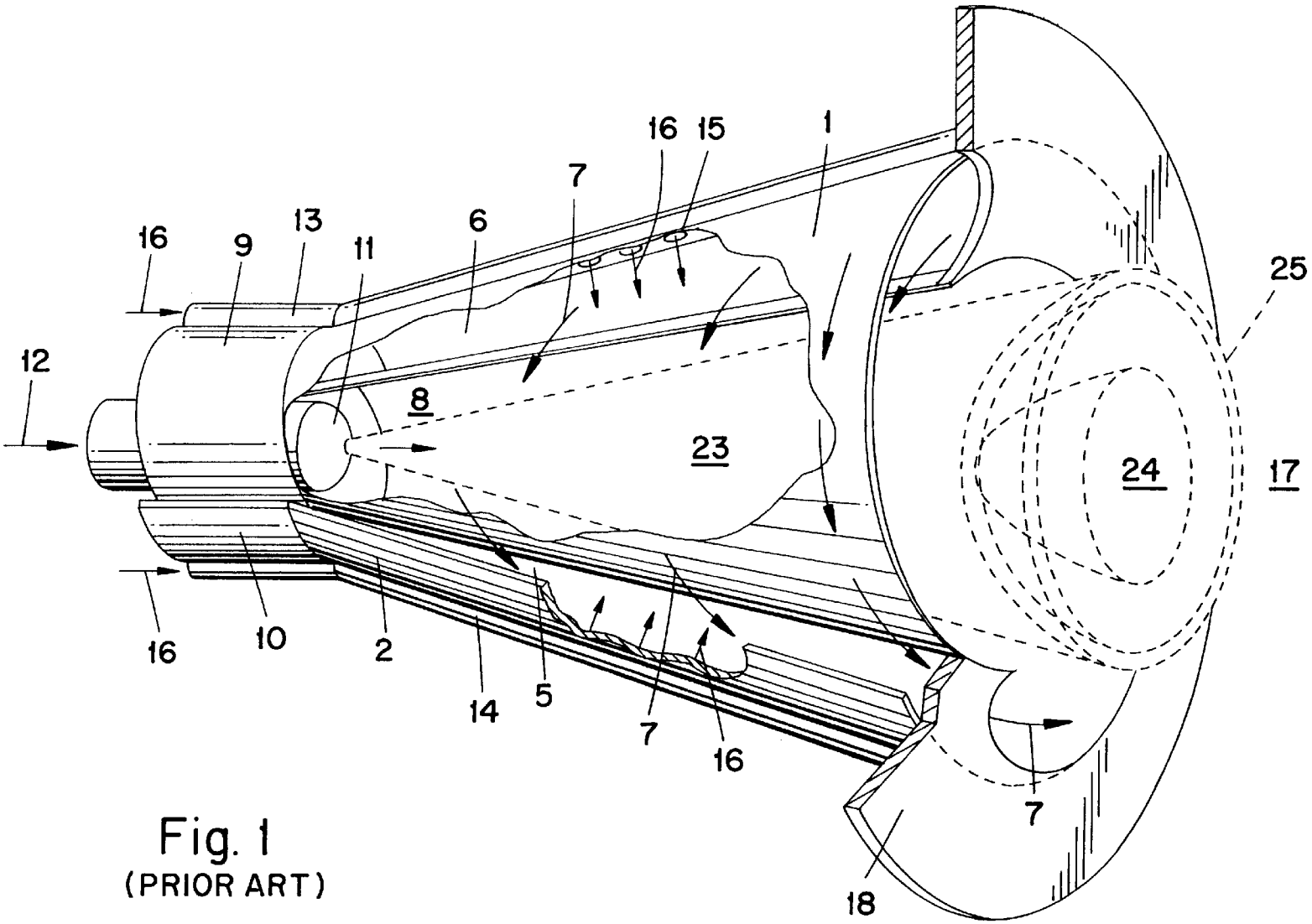
Fig. 1 (PRIOR ART)
FIG. 1 shows a premix burner of the double-cone design according to the known prior art in perspective representation.

Referring now to the drawings, wherein like reference numerals designate identical or corresponding parts throughout the several views, only the elements essential for understanding the invention are shown, and the direction of flow of the media is designated by arrows, the invention relates to the operation of swirl-stabilized burners. Examples of swirl-stabilized premix burners disclosed by the prior art are depicted in FIGS. 1 to 6, which are described further below. Burners of this type are operated with gaseous and/or liquid fuels, which are intensively mixed with combustion air or a mixture of combustion air and recycled flue gases inside the burner by a swirl generator and are then burned. These burners are designed in such a way that a supercritical swirl coefficient results, so that the vortices of the fuel/air mixture break down and form a backflow zone, which stabilizes the flame.

The method according to the invention, then, consists in the fact that air, so-called starting air, is additionally injected during the starting action at the downstream end of the swirl generator in such a way as to be directed from the margin of the burner into the center. This starting air must have at least a radial velocity component, but it may likewise also have an axial and/or a tangential velocity component.

Most of the cold starting air passes through the reaction zone into the hot vortex-breakdown zone and at the same time transports fuel into the center and then in the direction of the swirl generator. Consequently, both mass flows participate immediately in the reaction and heat up considerably before the flame-stabilization point is reached. Purging of the surrounding area with cold medium is thereby prevented. In addition, zones of high shear and turbulence are produced between the injected starting air and the swirled main flow and these zones additionally intensify the transport of substances and improve the flame stabilization. The central backflow bubble is cut off and an intensive fireball develops in the immediate vicinity of the burner. These phenomena create favorable ignition conditions, improve the flame stabilization, and reduce the starting emissions. If the starting air is injected with a swirl opposed to the swirled main flow (fuel/air mixture), the abovementioned effects are especially pronounced.

When the starting phase of the burner has been completed, the feeding of starting air is ended by, for example, a valve arranged in the fuel lines being closed. The premix burner therefore functions just as before during normal operation and is completely unaffected by the abovementioned starting method.

Figure 2:
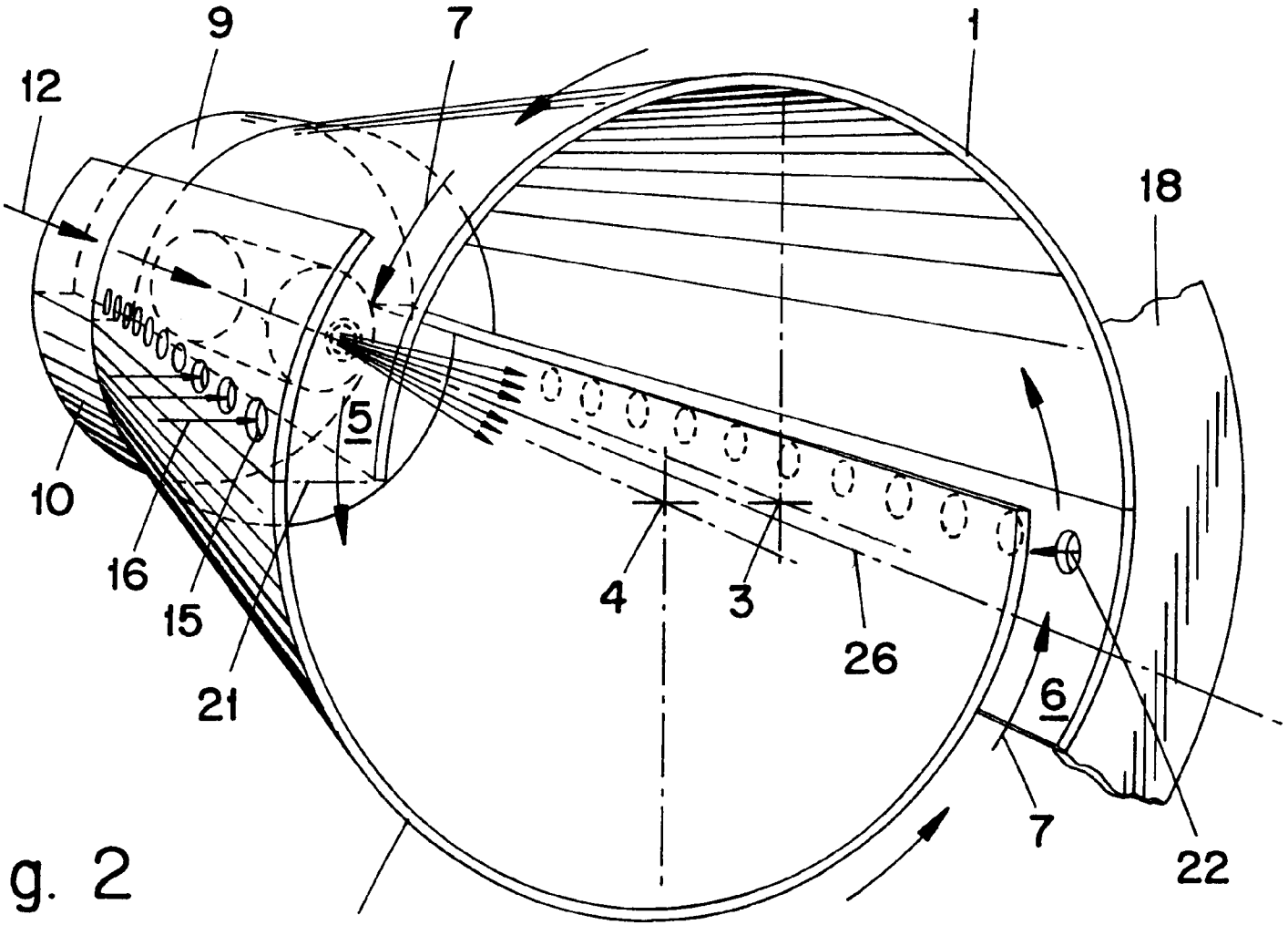
Fig. 2 (PRIOR ART)
FIG. 2 shows a further perspective representation of this premix burner in another view and in simplified form.

FIG. 1 shows a known premix burner of the double-cone design in perspective representation. In order to better understand the subject matter, it is advantageous if FIG. 2 is also used at the same time for the comprehension of FIG. 1. The main purpose of these two figures is to define the type and the mode of operation of such a burner.

The premix burner according to FIG. 1 consists of two hollow conical sectional bodies 1, 2, which are nested one inside the other in a mutually offset manner. It is operated with a gaseous and/or liquid fuel 12, 16. Here, the expression "conical" not only refers to the conical shape shown, which is characterized by a fixed opening angle, but also includes other configurations of the sectional bodies, thus a diffuser shape or diffuser-like shape as well as a confuser shape or confuser-like shape. These shapes are not specifically shown here, since they are readily familiar to the person skilled in the art. The mutual offset of the respective center axis or longitudinal symmetry axis of the sectional bodies 1, 2 (cf. FIG. 2, item 3, 4) provides on both sides, in mirror-image arrangement, one tangential air-inlet duct 5, 6 each, through which the combustion air 7 flows into the interior space of the premix burner, i.e. into the conical hollow space 8. The two conical sectional bodies 1, 2 each have a cylindrical initial part 9, 10, which parts likewise run offset from one another in a manner analogous to the aforesaid sectional bodies 1, 2, so that the tangential air-inlet ducts 5, 6 are present over the entire length of the premix burner. A nozzle 11, preferably for the atomization of a liquid fuel 12, is accommodated in the region of the cylindrical initial part in such a way that the injection of the liquid fuel 12 coincides approximately with the narrowest cross section of the conical hollow space 8 formed by the sectional bodies 1, 2. The injection capacity and the mode of operation of this nozzle 11 depend on the predetermined parameters of the respective premix burner. The fuel 12 injected through the nozzle 11 may be enriched with a recycled exhaust gas if required; it is then also possible to effect the complementary injection of a quantity of water through the nozzle 11.

It is of course possible for the premix burner to be designed in a purely conical manner, that is, without cylindrical initial parts 9, 10. Furthermore, the sectional bodies 1, 2 each have a fuel line 13, 14, which fuel lines are arranged along the tangential inlet ducts 5, 6 and are provided with injection openings 15 through which preferably a gaseous fuel 16 is injected into the combustion air 7 flowing past there, as symbolized by arrows 16, this injection at the same time forming the fuel-injection plane (cf. FIG. 2, item 22) of the system. These fuel lines 13, 14 are preferably positioned at the latest at the end of the tangential inflow, before entering the conical hollow space 8, in order to ensure optimum air/fuel mixing.

The premix burner has a front plate 18, which serves as anchorage for the sectional bodies 1, 2 and is arranged directly at the front part of the combustion space 17.

If the premix burner, as already described, is operated solely by means of a liquid fuel 12, this takes place via the central nozzle 11, in which case this fuel 12 is then injected at an acute angle into the conical hollow space 8 or the combustion space 17. Forming from the nozzle 11, therefore, is a conical fuel profile 23, which is enclosed by the rotating combustion air 7 flowing in tangentially. The concentration of the injected fuel 12 is continuously reduced in the axial direction by the inflowing combustion air 7 to form an optimum mixture.

If the premix burner is operated with a gaseous fuel 16, this may in principle also take place via the central fuel nozzle 11; however, such a mode of operation is preferably to be carried out via the injection openings 15, this fuel/air mixture being formed directly at the end of the air-inlet ducts 5, 6.

During the injection of the liquid fuel 12 via the nozzle 11, the optimum, homogeneous fuel concentration over the cross section is achieved at the end of the premix burner. If the combustion air 7 is additionally preheated or enriched with a recycled exhaust gas, this provides lasting assistance for the vaporization of the liquid fuel 12 within the premix section induced by the length of the premix burner. As far as the admixing of a recycled flue gas is concerned, reference is made to FIGS. 3–6.

The same considerations also apply if liquid fuels are now to be fed via the fuel lines 13, 14 instead of gaseous fuels.

Narrow limits per se are to be adhered to in the configuration of the conical sectional bodies 1, 2 with regard to the increase in the cross section of flow as well as to the width of the tangential air-inlet ducts 5, 6 so that the desired flow field of the combustion air 7 can appear at the outlet of the premix burner. The critical swirl coefficient appears at the outlet of the premix burner: a backflow zone 24 (vortex breakdown) also forms there, with a stabilizing effect relative to the flame front 25, acting there, in the sense that the backflow zone 24 performs the function of a bodiless flame retention baffle.

The optimum fuel concentration over the cross section is not achieved until the region of the vortex breakdown, that is, in the region of the backflow zone 24. Not until this point is a stable flame front 25 then produced. The flame-stabilizing effect results from the swirl coefficient, forming in the conical hollow space 8, in the direction of flow along the cone axis. Flashback of the flame into the interior of the premix burner is thus prevented.

In general, it may be said that, by an adaptation of the throughflow opening of the tangential air-inlet ducts 6, 7, it is possible to form the backflow zone 24 from the end of the premix section. Furthermore, the construction of the premix burner is especially suitable for changing the throughflow opening of the tangential air-inlet ducts 5, 6 according to requirements, whereby a relatively large operational range can be covered without changing the overall length of the premix burner.

The sectional bodies 1, 2 may of course also be displaced relative to one another in another plane, as a result of which the sectional bodies 1, 2, as apparent from FIG. 2, may even be overlapped in the region of the tangential air-inlet ducts 5, 6 relative to the air-inlet plane leading into the conical hollow space 8 (cf. FIG. 2, item 21). It is then also possible to nest the sectional bodies 1, 2 spirally one inside the other by a contra-rotating movement.

Due to a more homogeneous mixture formation between the injected fuels 12, 16 and the combustion air 7, which mixture formation can be achieved in this premix burner, lower flame temperatures and thus lower pollutant emissions, in particular lower NOx values, are achieved. These lower temperatures then reduce the thermal loading on the material at the burner front and consequently a special treatment of the surface, for example, is not absolutely necessary.

As far as the number of air-inlet ducts is concerned, the premix burner is not restricted to the number shown. A larger number, for example, is appropriate where the aim is to apply wider premixing or to accordingly influence the swirl coefficient and thus the formation of the backflow zone 24, this formation depending on the swirl coefficient, by a larger number of air-inlet ducts.

Premix burners of the type described here are also those which, in order to achieve a swirl flow, start from a cylindrical or quasi-cylindrical tube, the inflow of combustion air into the interior of the tube being effected via likewise tangentially positioned air-inlet ducts, and a conical body having a cross section decreasing in the direction of flow being arranged in the interior of the tube, whereby a critical swirl coefficient at the outlet of the burner can also be achieved with this configuration.

FIG. 2 shows the same premix burner according to FIG. 1, but from another perspective and in simplified representation. FIG. 2 is essentially intended to provide a full appreciation of the configuration of this premix burner. In particular, the mutual offset of the two sectional bodies 1, 2, relative to the main center axis 26 (=burner axis) of the premix burner, which corresponds to the main axis of the central fuel nozzle 11, can be seen really well in FIG. 2. This offset actually induces the size of the throughflow openings of the tangential air-inlet ducts 5, 6. Here, the center axes 3, 4 run parallel to one another.

Figure 3:
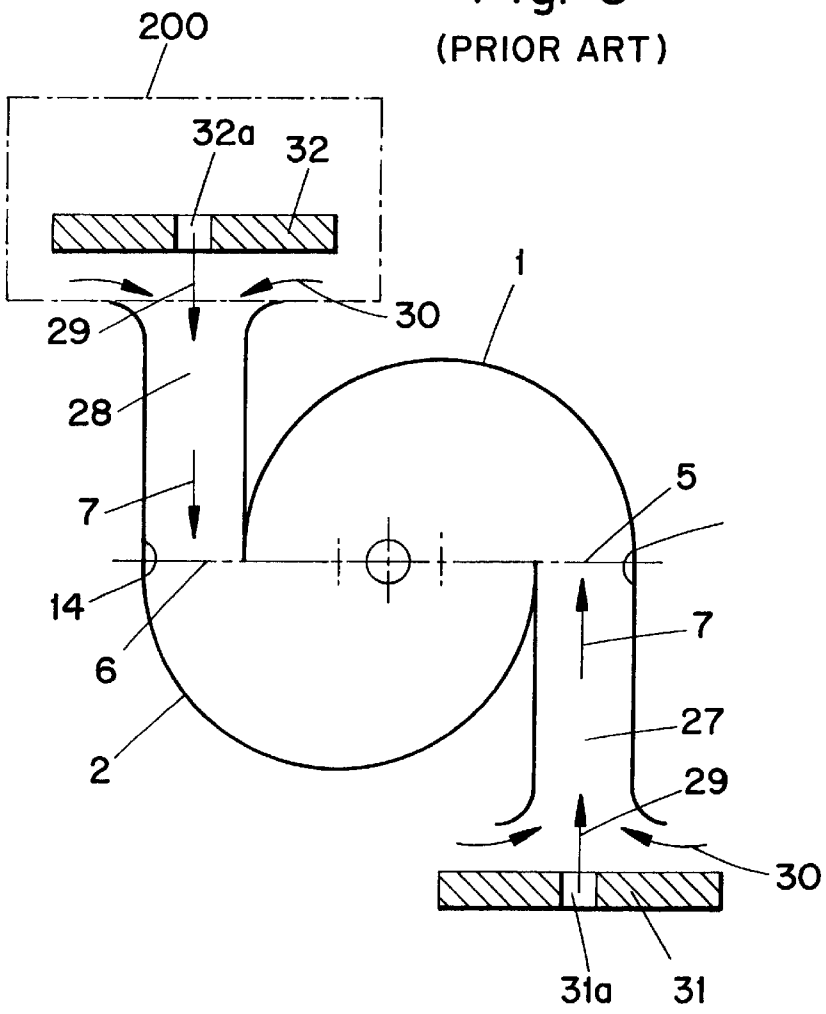
Fig. 3 (PRIOR ART)
FIG. 3 shows a section through the premix burner according to FIG. 1 or 2, the burner being fitted with injectors and the inflow plane of feed ducts running parallel to the burner axis.

FIG. 3 is a section approximately in the center of the premix burner. The feed ducts 27, 28, which are arranged tangentially in mirror image, perform the function of a mixing section, in which feed ducts 27, 28 the combustion air 7, formed from fresh air 29 and recycled flue gas 30, is perfected. The combustion air 7 is prepared in an injector system 200. Upstream of each feed duct 27, 28, which serves as a tangential inflow into the interior space 8 of the premix burner, the fresh air 29 is uniformly distributed over the entire length of the premix burner via perforated plates 31, 32. These perforated plates 31, 32 are perforated in the direction of flow toward the tangential inlet ducts 5, 6. The perforations perform the function of individual injector nozzles 31*a*, 32*a*, which exert a suction effect relative to the surrounding flue gas 30 in such a way that each of these injector nozzles 31*a*, 32*a* in each case draws in only a certain proportion of flue gas 30, whereupon uniform flue-gas admixing takes place over the entire axial length of the perforated plates 31, 32, which corresponds to the burner length. This configuration causes intimate mixing to take place as early as at the contact location of the two media, that is, of the fresh air 29 and the flue gas 30, so that the flow length, extending up to the tangential air-inlet slots 5, 6, of the feed ducts 27, 28 for the mixture formation can be minimized. In addition, the injector configuration 200 here is distinguished by the fact that the geometry of the premix burner, in particular as far as shape and size of the tangential air-inlet ducts 5, 6 are concerned, remains dimensionally stable, i.e. no thermally induced distortions develop due to the uniformly metered distribution of the flue gases 30, which are hot per se, along the entire axial length of the premix burner. The same injector configuration as that just described here may also be provided in the region of the head-side fuel nozzle 11 for an axial feed of combustion air.

Figure 4:
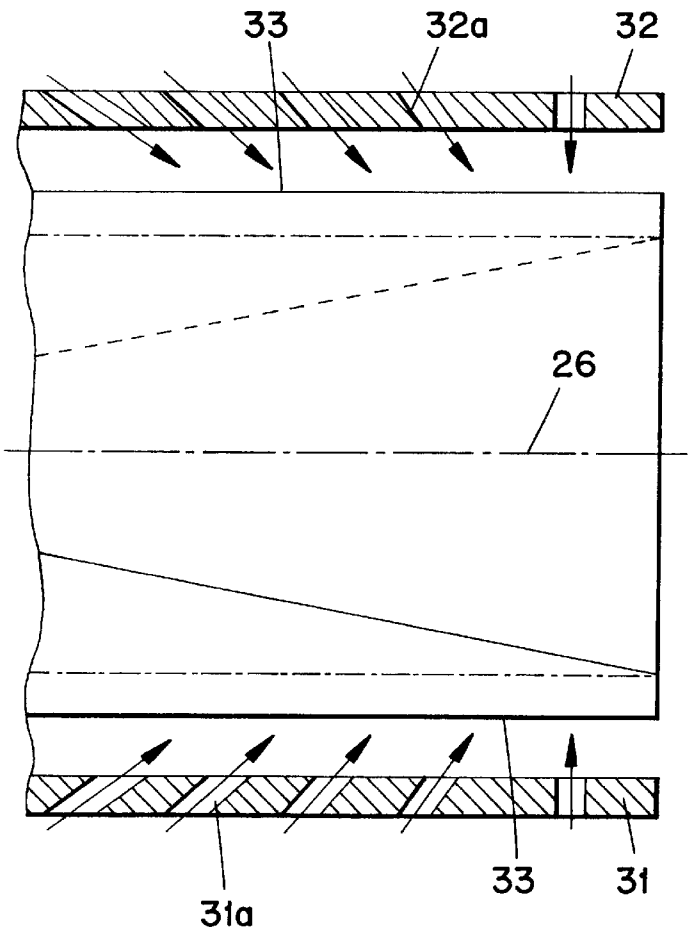
Fig. 4 (PRIOR ART)
FIG. 4 shows a configuration of the injector system in the direction of flow.

FIG. 4 is a schematic representation of the premix burner in the direction of flow, wherein in particular the course of the perforated plates 31, 32 belonging to the injector system 200 relative to the inflow planes 33 of the feed ducts 27, 28 finds expression. This course is parallel, the inflow planes 33 themselves running parallel to the axis 26 of the premix burner over the entire burner length. It can also be seen in this figure how the injector nozzles 31*a*, 32*a* vary their inflow angle relative to the axis 26 of the premix burner in the direction of flow. From an initial acute angle in the region of the head stage of the premix burner, they gradually straighten up until they are approximately perpendicular to the burner axis 26 in the region of the outlet. By this measure, the mixing quality of the combustion air is increased and the backflow zone is held in a stable position. In other embodiments, right-angled inflows may also be used.

Figure 5:
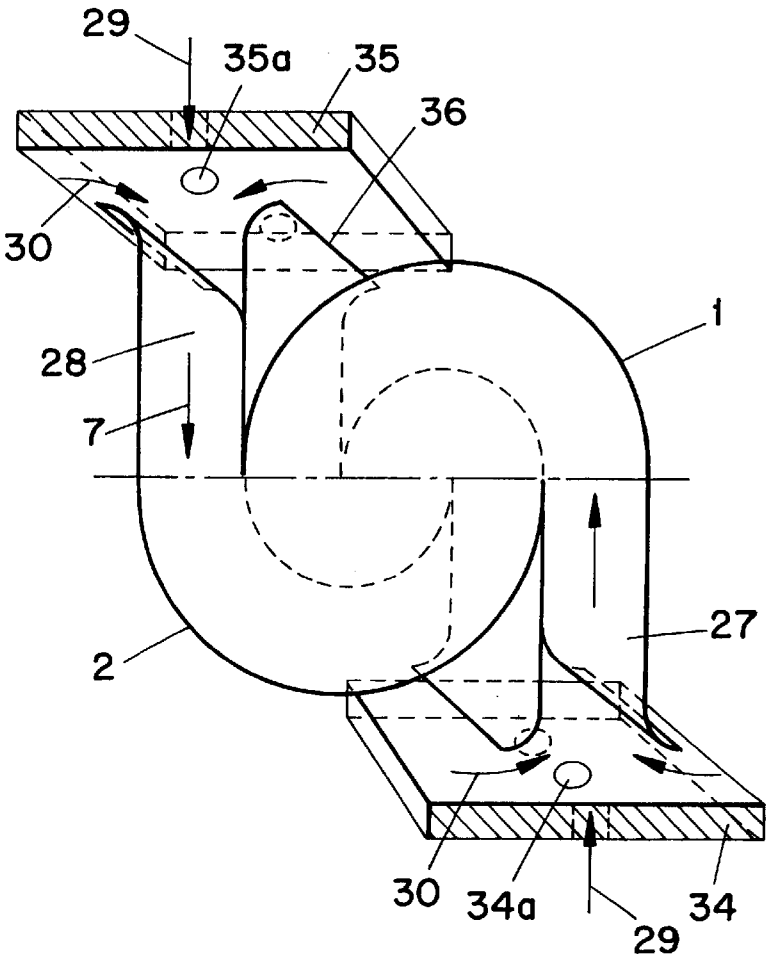
Fig. 5 (PRIOR ART)
FIG. 5 shows a section through the premix burner according to FIG. 1 or 2, the burner being fitted with injectors and the inflow plane of feed ducts running conically relative to the burner axis.
Figure 6:
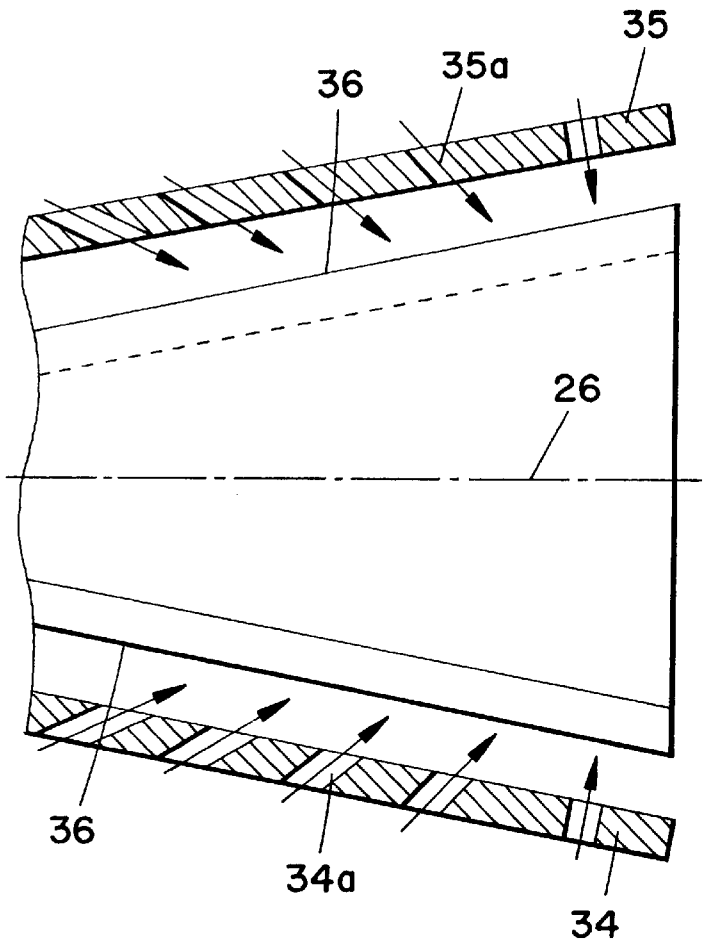
Fig. 6 (PRIOR ART)
FIG. 6 shows a further configuration of the injector system in the direction of flow.

FIGS. 5 and 6 show essentially the same configuration as FIGS. 3 and 4, the perforated plates 34, 35 with the associated injector nozzles 34*a*, 35*a* likewise running parallel to the inflow planes 36 of the feed ducts 27, 28 over the entire burner length. However, these inflow planes 36 run conically relative to the axis 26 of the premix burner. The variable inflow angle of the injector nozzles 34*a*, 35*a* in the direction of flow also largely corresponds here to the configuration according to FIGS. 3 and 4, the gradual straightening-up of these injector nozzles 34*a*, 35*a* to a perpendicular inflow in the region of the outlet of the premix burner being oriented here primarily relative to the inflow plane 36 of the respective feed duct.

Figure 8:
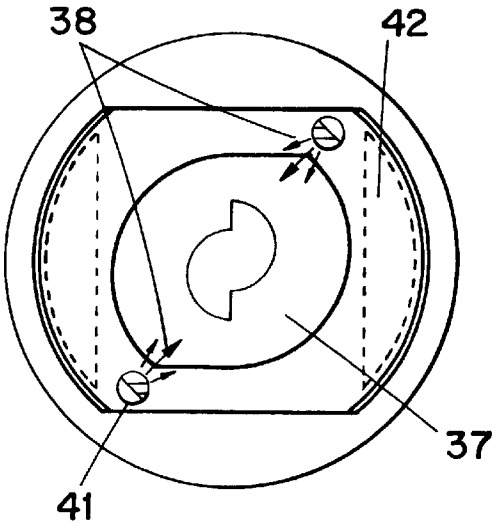
FIG. 8 shows a front view of the burner according to FIG. 7.
Figure 7:
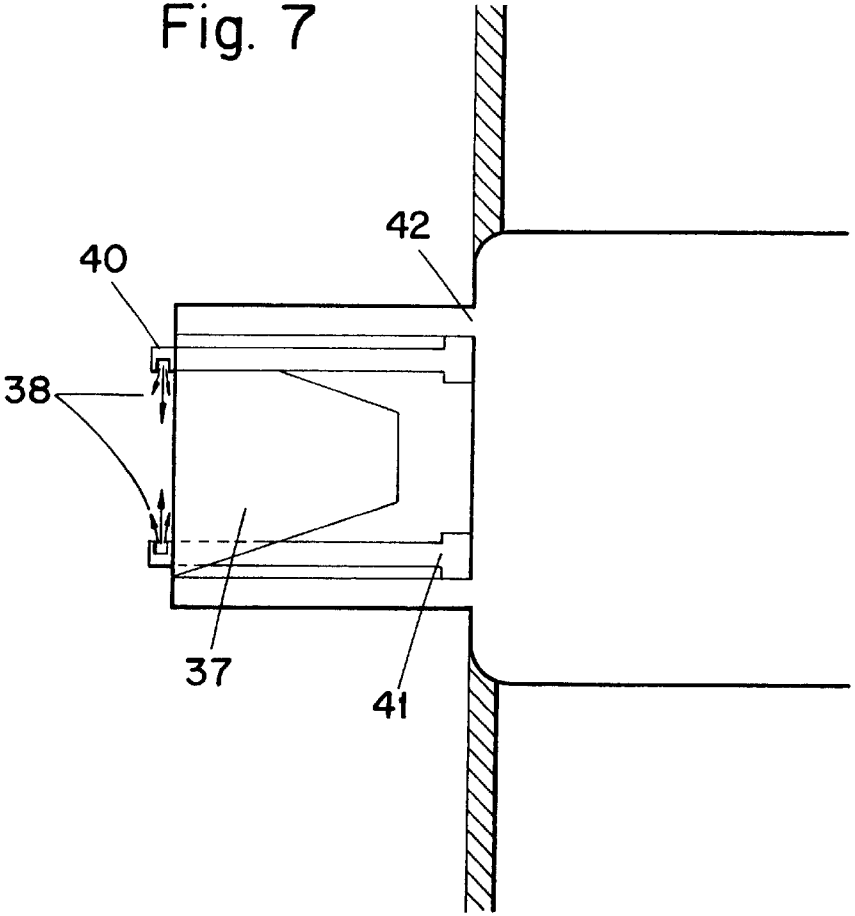
FIG. 7 shows a schematic longitudinal section of the premix burner according to the invention in a first embodiment variant.

FIG. 7, in a schematic partial longitudinal section, shows a first embodiment variant of a premix burner for carrying out the method according to the invention; FIG. 8 shows the front view. The basic construction of the burner corresponds to the burner described in FIGS. 1 and 2. A swirl body 37 (conical sectional body 1, 2) generates a swirled main flow (fuel/air mixture 39), into which starting air 38 is injected purely radially at the downstream end of the swirl body 37 via the two openings 40 arranged opposite one another. The means 40 are connected to feed lines 41, which provide the starting air 38 independently of the burner air feed 42. The feed lines 41 can be opened or closed as desired by means of a valve (not shown here).

Figure 10:
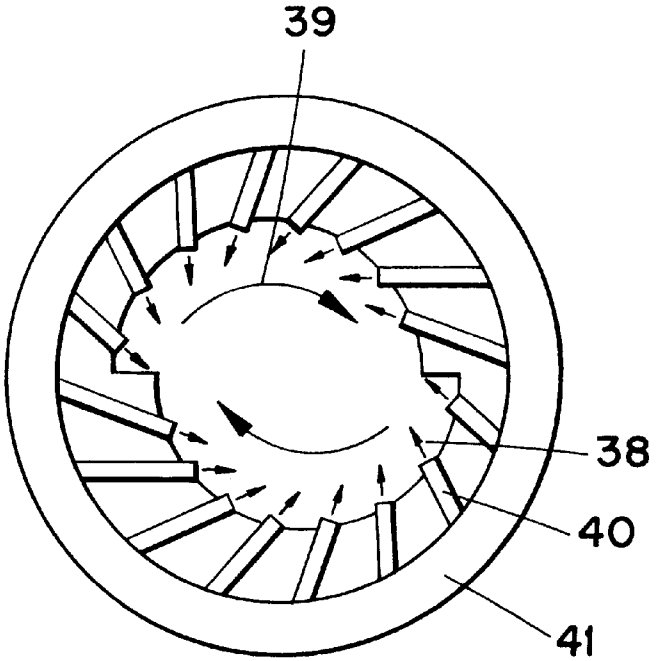
FIG. 10 shows a front view of the burner according to FIG. 9.
Figure 9:
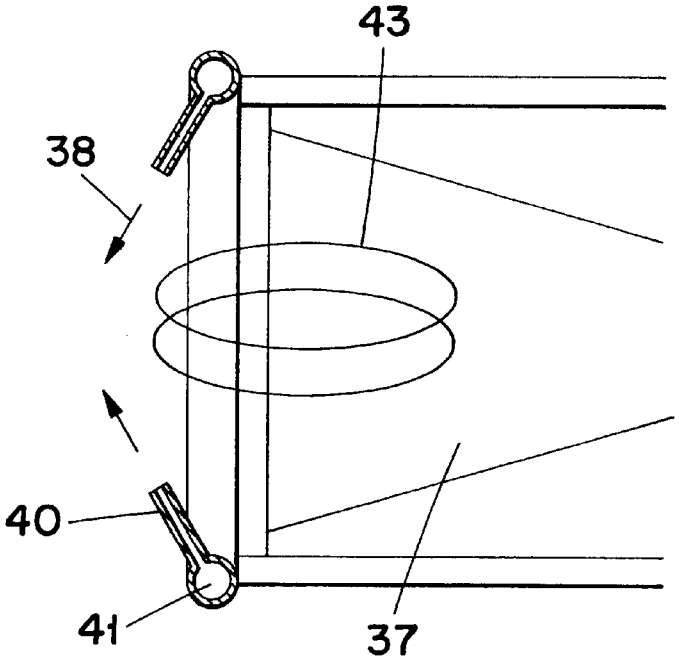
FIG. 9 shows a schematic longitudinal section of the premix burner according to the invention in a second embodiment variant.

FIGS. 9 and 10 show a second embodiment variant of the premix burner. Here, sixteen tubes 40 of different length are arranged in a symmetrically distributed manner over the periphery of the swirl generator 37 at the downstream end of the latter. A different number of tubes 40 may of course be used in other exemplary embodiments. The tubes 40 are not oriented purely radially as in the first exemplary embodiment but additionally have an axial and tangential direction component. They extend up to the inner wall of the swirl generator 37, that is, up to the cone shells. This results in their different length. The tubes 40 are connected to a ring line 41, which feeds the starting air 38. The starting air 38 is injected with a swirl opposed to the main flow 39. Since the tubes 40 extend directly up to the cone shells, the starting-air jets 38 do not disintegrate prematurely but cause zones of high shear and turbulence to develop, and these zones intensify the mixing. The ignition conditions and the flame stabilization are thereby improved. As shown in FIG. 9, the central backflow bubble 24 is cut off and an intensive fireball 43 develops in the immediate vicinity of the burner.

The invention is of course not restricted to the exemplary embodiments described here but can be applied to all swirl-stabilized burners.

Obviously, numerous modifications and variations of the present invention are possible in light of the above teachings. It is therefore to be understood that, within the scope of the appended claims, the invention may be practiced otherwise than as specifically described herein.

What is claimed as new and desired to be secured by Letters Patent of the United States is:

1. A method of operating a swirl-stabilized burner comprising the steps of:

forming a mixture by injector delivery of a fuel selected from the group consisting of gaseous fuels, liquid fuels, and both gaseous fuels and liquid fuels, with an oxidant selected from the group consisting of combustion air and a mixture of recycled flue gas and fresh air;

intensively mixing said mixture with a swirl generator;

starting burning said mixture as a flame;

forming a backflow zone which stabilizes said flame;

injecting starting air having at least a radial velocity component during said starting step at a downstream end of said swirl generator, said radial velocity component being from the margin of the burner toward the center of the burner; and terminating said step of injecting starting air while continuing to burn said mixture.

2. The method as claimed in claim 1, wherein said step of injecting the starting air comprises injecting the starting air purely radially.

3. The method as claimed in claim 1, wherein said step of injecting the starting air comprises injecting the starting air in a direction which includes both radial and axial components.

4. The method as claimed in claim 1, wherein said step of injecting the starting air comprises injecting the starting air in a direction which includes both radial and tangential components.

5. The method as claimed in claim 1, wherein step of intensively mixing comprises swirling said mixture in a first direction, and said step of injecting the starting air comprises injecting the starting air with a swirl direction opposite to said fuel/air mixture first swirl direction.

6. A burner for operating a firing plant with gaseous and/or liquid fuels comprising:

a swirl generator for mixing fuel and an oxidant selected from the group consisting of combustion air and a mixture of fresh air and recycled flue gases to form a mixture, and for generating a supercritical swirl of said mixture, said swirl generator having a periphery, an upstream end, and a downstream end; and at least two means for at least partially radially injecting starting air arranged opposite one another at said downstream end of said swirl generator, said means for at least partially radially injecting including feed lines and valves to allow said feed lines to be opened or closed.

7. The burner as claimed in claim 6, wherein said means for at least partially radially injecting is arranged in a symmetrically distributed manner over said periphery of the swirl generator at said downstream end of said swirl generator.

8. The burner as claimed in claim 7, wherein said swirl generator comprises an inner wall, and said means for at least partially radially injecting comprises tubes and a ring feed line, and wherein said tubes extend directly up to said swirl generator inner wall.

9. The burner as claimed in claim 6, further comprising:

at least two hollow conical sectional bodies nested one inside the other, each sectional body having a center axis and a wall, said center axes offset from one another in such a way that said sectional body walls form tangential air-inlet ducts for combustion air; and at least one fuel nozzle.

10. The burner as claimed in claim 9, wherein said burner has a center burner axis, and said at least one fuel nozzle is arranged at said upstream end on said burner axis.

11. The burner as claimed in claim 9, wherein said at least one fuel nozzle comprises a plurality of spaced-apart fuel nozzles arranged adjacent to said tangential air-inlet ducts.

12. The burner as claimed in claim 9, wherein said sectional bodies form a conical hollow space therebetween, and the cross section of flow of said conical hollow space increases downstream.

13. The burner as claimed in claim 9, wherein said sectional bodies form a conical hollow space therebetween, and the cross section of flow of said conical hollow space forms a profile selected from the group consisting of a diffuser, a diffuser-like profile, a confuser, and a confuser-like profile.

14. The burner as claimed in claim 9, wherein said sectional bodies are nested spirally one inside the other.

15. The burner as claimed in claim 9, further comprising at least one feed duct, each of said at least one feed duct including at least one injector system for the provision of combustion air comprising fresh air and reacted gases, each of said at least one feed duct extending in a direction including at least a radial component relative to said air-inlet ducts.

16. The burner as claimed in claim 9, wherein said at least one injector system comprises perforated plates running parallel to an inflow plane of combustion air into said at least one feed duct, wherein said perforated plates include injector nozzles each having an inflow angle which varies in the axial direction of the burner relative to the burner axis.

17. The burner as claimed in claim 16, wherein said injector nozzles together define a throughflow plane in the region of the head stage of the burner which includes an acute angle, said acute angle gradually increasing in the axial direction of said perforated plates until it is substantially perpendicular to said feed duct inflow planes, to said burner axis in the region of the outlet of the burner, or both.

* * * * *